United States Patent [19]

Stomp et al.

[11] Patent Number: 4,893,791

[45] Date of Patent: Jan. 16, 1990

[54] AUTOMATIC LANCE CHANGEOVER DEVICE

[75] Inventors: Hubert Stomp, Howald; Carlo Heintz; Andre Kremer, both of Luxembourg; Jean Monai, Petange, all of Luxembourg; Daniel Fries, Arlon, Belgium; Serge Devillet, Bissen, Luxembourg

[73] Assignee: Paul Wurth S.A., Luxembourg, Luxembourg

[21] Appl. No.: 241,530

[22] Filed: Sep. 7, 1988

[30] Foreign Application Priority Data

Sep. 7, 1987 [LU] Luxembourg ..... 86985

[51] Int. Cl.[4] ..... C21C 5/46

[52] U.S. Cl. ..... 266/226; 266/91

[58] Field of Search ..... 266/78, 91, 142, 225, 266/226, 287

[56] References Cited

U.S. PATENT DOCUMENTS 3,972,515 8/1976 Mercatoris ..... 266/225
4,533,125 8/1985 Mailliet et al. ..... 266/226

FOREIGN PATENT DOCUMENTS 56942 8/1982 European Pat. Off. ..... 266/226
2502977 8/1976 Fed. Rep. of Germany ..... 266/226

*Primary Examiner*—Robert McDowell
*Attorney, Agent, or Firm*—Fishman, Dionne & Cantor

[57] ABSTRACT

An automatic lance changeover device is presented wherein a radially guided ring is axially vertically displaceable by two lifting spindle systems provided on each side of the ring and bears pivotable hooks for receiving the lance and for pressing the latter axially against a sealing surface on the coupling head. The hooks are connected to the stationary coupling head via pivotable connecting rods whose length is alterable, these connecting rods being eccentrically articulated on the support pin of the hooks with the bearing bore at the coupling head end of the connecting rods having a larger diameter than the associated wrist pin. When the ring is axially displaced, the hooks, which have swung out, in a first phase, initially surround the supporting pins on the upper part of the lance as the ring is displaced further, the hooks, without executing any further pivoting movement, pull the lance head into sealing contact with the coupling head.

14 Claims, 4 Drawing Sheets

AUTOMATIC LANCE CHANGEOVER DEVICE

BACKGROUND OF THE INVENTION

This invention relates to the field of metal refining. More particularly, this invention relates to an automatic lance changeover device to which lances are coupled and fixed during steel production by a top blowing process to a vertically displaceable lance carriage.

Over the past few decades, processes have been developed wherein iron melts are desulfurized by the addition of materials which are capable of forming compounds with the sulphur in the melt at high temperatures and under certain reducing conditions. These additive materials are pulverized into granular form and introduced into the melt in suitably proportioned quantities by means of an immersion lance and a carrier gas, preferably argon.

After a certain period of use, the lances used in modern oxygen top blowing processes must be replaced because of wear. An installation for carrying out these replacement operations is described for example in European Pat. No. EP-B 1-0, 112, 540 corresponding to U.S. Pat. No. 4,533,125 assigned to the assigner hereof, all of the contents of which are incorporated herein by reference. Admittedly, in the case of the lances discussed therein, the design concerned is relatively simple, having only one central axial channel for feeding some of the substances required for refining into the molten metal. This does not present significant problems for the leakproof coupling of the upper end of the lance to the feed head for the refining material.

However, in addition to a central axial channel, more highly developed modern lances also have additional channels coaxial to this channel and having an annular cross-section. These channels not only provide the possibility of passing different gas streams through one and the same lance, but also the possibility of cooling the lance, for example with water, for which purpose of course a supply and a discharge channel are required.

Of course, these multichannel lances make far higher demands on the precision of the seal at the coupling between the fluid feed head on the lance carriage with its feed and discharge channels and the associated above mentioned channels in the lance head. A solution to this sealing problem and also a proposal for coupling the upper part of the lance to the fluid feed head, referred to below simply as the coupling head, of the lance carriage are described in patent document LU-69,797 corresponding to U.S. Pat. No. 3,972,515. This proposal consists of fixing the upper part of the lance on the coupling head by means of two swivel bolts and associated nuts.

However, this solution has several disadvantages. First of all, although the manual loosening and tightening of the nuts is not too time-consuming, in view of the location at which this operation takes place, it is associated with a latent accident risk. Furthermore, in the case of a manual changeover operation, there is the expense of holding personnel on call at all times.

SUMMARY OF THE INVENTION

The above discussed and other problems of the prior art are overcome or alleviated by the automatic lance changeover device of the present invention. In accordance with the present invention, a novel automatic lance changeover device is provided which permits a lance changeover with a minimum expenditure of time and guarantees that the two contact surfaces are pressed against one another with a precisely predetermined force, thereby providing optimum sealing while sparing wear on the contact surface to the greatest extent possible.

The automatic lance changeover device of this invention is used with lances which are coupled and fixed during steel production by a top blowing process to a vertically displaceable lance carriage. The refining substances and cooling fluid are fed to a coupling head on the lance carriage and transferred into the upper part of the lance at the coupling between the coupling head and the upper part of the lance. The lance changeover device uses at least one hook actuating mechanism, load cells, and a lance carriage to achieve its results.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
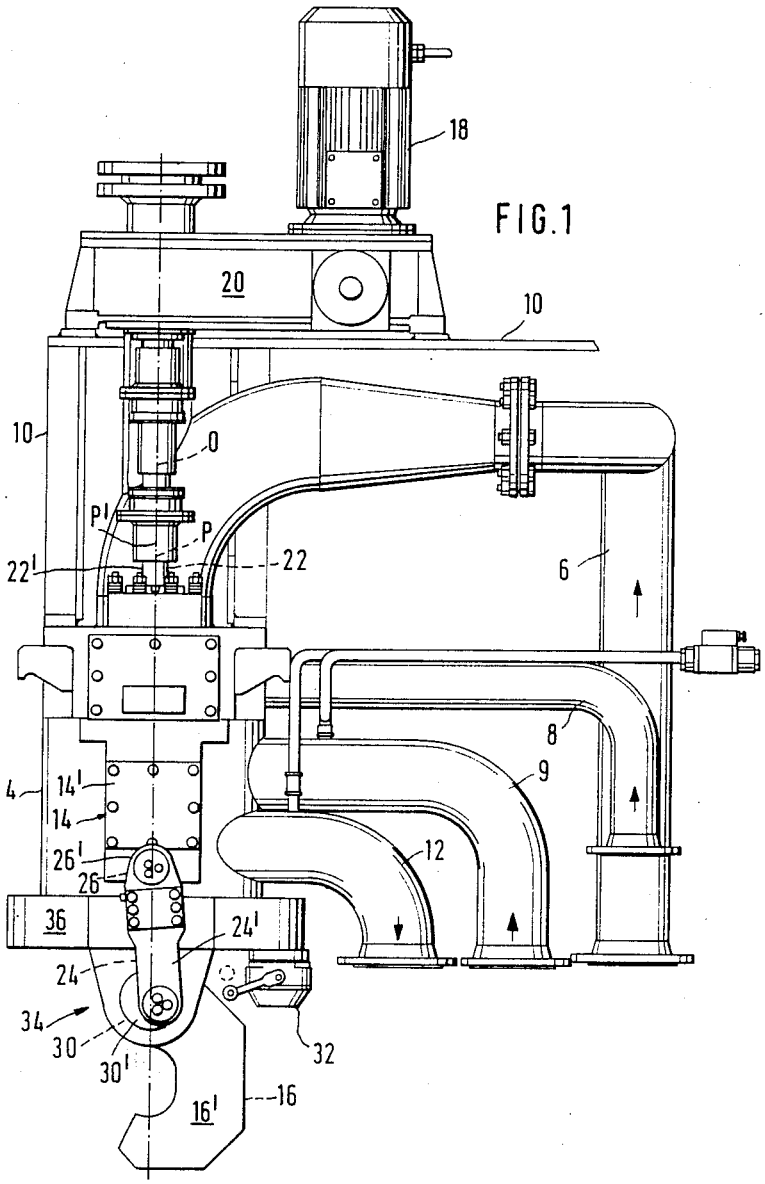
FIG. 1 is a general partial side elevation view of the lance carriage with the coupling head, which forms a single mechanical unit with the latter, and the lance changeover device associated with the coupling head having the drive motor and the gear for the vertical displacement of the device relative to the coupling head; as well as the refining agent lines and coolant lines.
Figure 2:
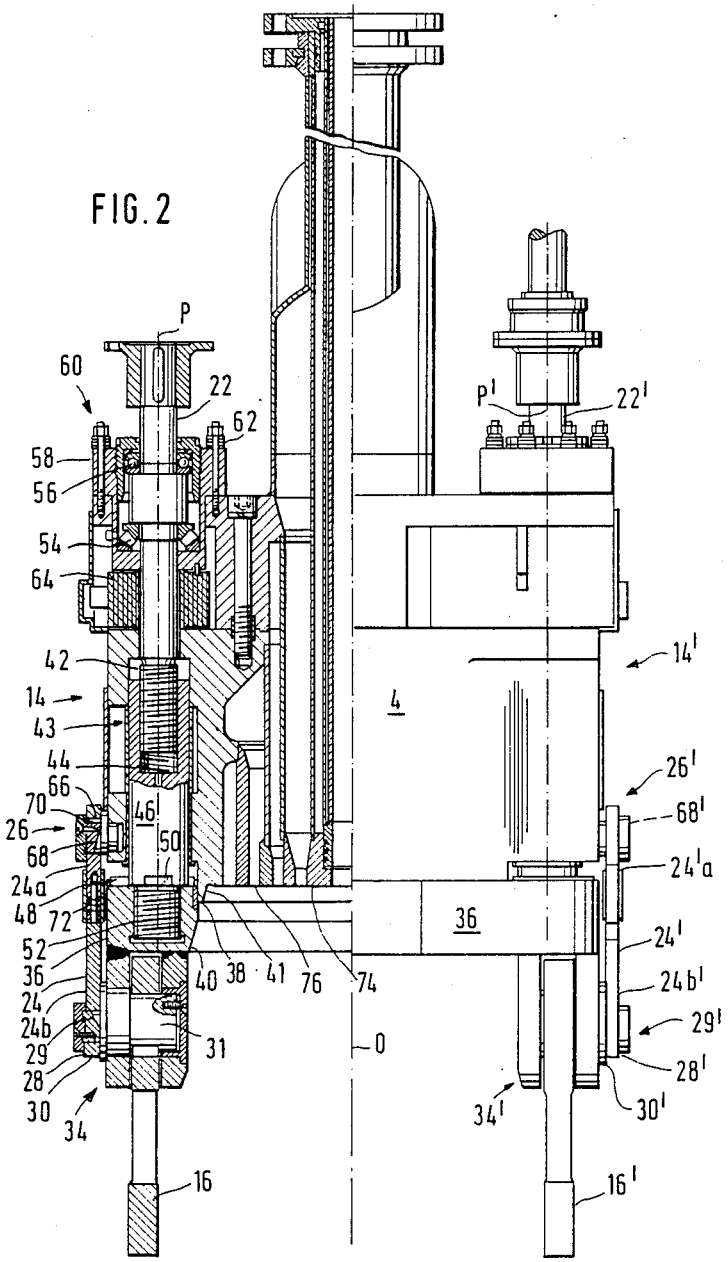
FIG. 2 is a partial cross sectional view through the front elevation of the device of the present invention.

Viewing FIGS. 1, 2 and 3 jointly, an automatic lance changeover device in accordance with the present invention is shown . The lance changeover device includes a lance carriage 10 (indicated by thin solid lines). Rigidly fixed to carriage 10 is a coupling head 4 into which, in the exemplary embodiment illustrated, a primary oxygen line 6, a secondary oxygen line 8 and a cooling water line 9 discharge. The cooling water is discharged via a line 12. The automatic lance changeover device has two identical hook actuating mechanisms 14, 14' attached on each side of coupling head 4. Of these, there can be seen in FIG. 1 receiving hooks 16, 16' (16 obscured by 16') on which lances (not shown) are suspended by means of supporting pins. A drive motor 18 includes a downstream step-down gear 20 which in each case drives vertical shaft 22, 22'. Above each hook 16, 16' and, for each hook, a connecting rod 24, 24' (24 not visible in FIG. 1) is pivotably articulated by its upper end 26, 26' to coupling head 4 and by its lower end 28, 28' (both rotatably and eccentrically by means of an eccentric pin 29, 29') to bearing pin 30, 30 having an axis of rotation 31 of hook 16,16', which is mounted for fast rotation on this bearing pin. Each of shafts 22, 22' drives a lifting spindle system 43 which is described in detail below with reference to FIG. 2 and by means of which a vertical relative movement with respect to coupling head 4 and lance carriage 10 can be imparted to the hooks 16, 16'.

It can be clearly seen in FIG. 1 that, when supporting pin 30' is displaced downwards together with hook 16' relative to the coupling head 4, connecting rod 24' imparts an anticlockwise pivoting movement to hook 16'. This pivoting movement is limited by a limit switch 32 which stops drive motor 18. When hook 16' is upwardly displaced, it naturally pivots in the opposite direction and finally returns to the position shown in FIG. 1. These movements take place synchronously for both hooks 16, 16'.

Details of the two identical hook actuating mechanisms 14, 14' will now be described in greater detail for both hooks 16, 16'.

Referring to FIG. 2 bearing pin 30 of hook 16 is rotatably mounted on a bifurcated double eye 34 (eye 34' for hook 16'), which eyes are welded on each side of central axis 0 of coupling head 4 to a vertically displaceable supporting ring 36. For the purpose of vertical displacement, this supporting ring 36 has a conical-abutment surface 74 for a correspondingly contoured counter-abutment surface 79,80 on the upper part 78 of lance 77 (FIG. 3a) for introducing lance 77 into the coupling head 4. The vertical or axial displacement of ring 36 is accomplished by means of a lifting spindle system 43 which is well known per se. This is formed by an external thread 42 on the lower end of shaft 22 and by a corresponding internal thread 44 on an essentially cylindrical thrust piece 46. Thrust piece 46 must be secured against rotation. In the drawing, this is accomplished by a locking ring 48 which interacts with a flat portion 50 on thrust piece 46 and is fixed for rapid rotation on ring 36. Screw connection 52 between the lower end of the thrust piece 46 and ring 36 is thereby secured at the same time.

Shaft 22 together with all the parts which adjoin it towards the bottom, such as lifting spindle system 43, supporting ring 36, supporting eye 34 and the associated hook 16, are supported by a tapered roller bearing 54 to define an angular bearing.

In order to reduce the axial play of the hook actuating mechanism 14 to a minimum, angular bearing 54 is axially preloaded. As can be seen from FIG. 2, this is achieved by means of a ball bearing 56 preloaded vertically downwards, the preloading being produced by a bearing block 58 for ball bearing 56, which can be pressed with any desired force against bearing 56 by means of stud bolts 60 and interposed annular springs 62.

A very important feature of hook actuating mechanism 14 is a load cell 64 by means of which the force acting on hook 16 can be continuously measured, the measurement values displayed also including of course the dead weight of the system as well as the above mentioned preloading of the bearing; these factors can of course be taken into account by corresponding calibration at zero load. The actual purpose of load cell 46 will emerge from the description of FIGS. 3a to 3g given below.

Two further important features of the present invention are to be found on connecting rod 24. An upper clearance 66 can be seen between wrist pin 68 for the upper end 26 of connecting rod 24 and its associated bore 70. This clearance 66 can be obtained, for example, simply by making the bore larger by an appropriate amount than the diameter of pin 68 (see FIGS. 3a to 3g) or by making this "bore" as an elongated hole. It can furthermore be seen from FIG. 2 that connecting rod 24 comprises two parts 24a, 24b, inserted one in the other, between which there acts a compression spring 72. The purpose of these two features of the invention is likewise explained in the description of FIGS. 3a to 3b.

It will be appreciated that the preceding statements with respect to the hook actuating mechanism 14 also apply in analogous fashion to the identical mechanism 14'.

Attention is also drawn to the design of the coupling surfaces for the channel transition between coupling head 4 and the upper part 78 of the lance (FIG. 3a) as flat surfaces 74, 80 which are perforated by the various channels 76. It will be appreciated that sealing may be provided between these channels by, for example, O-rings (not shown).

FIGS. 3a to 3g show the various sequences gone through during the attachment of a new lance to coupling head 4 and to the lance carriage 10 (this carriage itself is not indicated in FIGS. 3a to 3g).

Figures 3A, 3B, 3C:
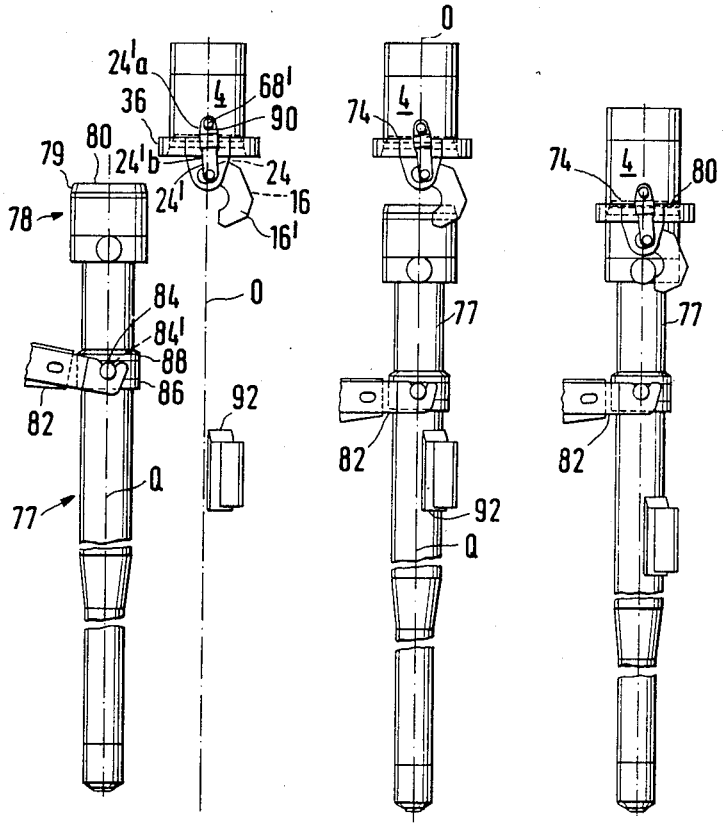
FIGS. 3*a–g* are side elevation views showing the sequences involved in the changeover of a new lance carriage.

In FIG. 3a, a new lance 77 is brought into a first position in front of coupling head 4 by means of a lance transfer car, for example of the type described in U.S. Pat. No. 4,533,125 described at the outset on which a bifurcated, pivotable double carrying lever 82 is provided on which lance 77 is suspended by means of two transfer supporting pins 84, 84' The transfer supporting pins 84, 84' are located on an axially displaceable sleeve 86 which during lance transfer and during the raising of lance 77 presses against a fixed stop 88 on the lance itself. In FIG. 3a, hooks 16, 16' are in the opened position, this being achieved, as explained above, by lowering ring 36 relative to coupling head 4 by means of hook actuating mechanisms 14, 14' (see FIG. 2). Since hooks 16, 16' move in synchronous fashion, only those of hook 16' and those of connecting rod 24' associated with it will be described below for the sake of simplicity. Connecting rod 24', which comprises parts 24a' and 24b', which can be displaced to a limited extent one within the other, is at its maximum length in FIG. 3a. By virtue of the lowering of the ring 36, the radial play mentioned between wrist pin 68' and the upper bore of the connecting rod manifests itself here as lower clearance 90 (corresponding to the upper clearance 66 in FIG. 2).

In FIG. 3b, lance 77 is brought into a second position by a combined pivoting and translational movement of double carrying lever 82 (as described in greater detail in U.S. Pat. No. 4,533,125,) under coupling head 4; axis 0 of the coupling head being in alignment with axis Q of the Lance. Simultaneously therewith, lance 77 has become inserted into a stabilizing cradle 92 provided on the lance carriage (not shown).

In FIG. 3c, double carrying lever 82 has maintained its position but lance carriage 82, together with coupling head 4 has been lowered by a certain amount, to an extent such that there is still a certain predetermined gap of, for example, 20 mm between the two flat coupling surfaces 74 (see also FIG. 2) and 80.

Figure 3D:
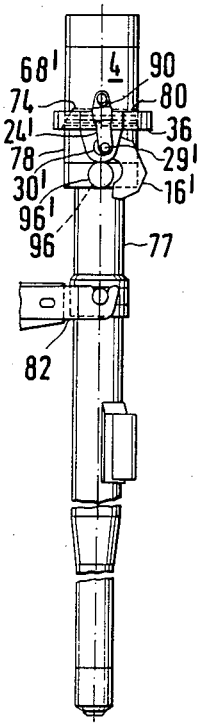
Figure 3E:
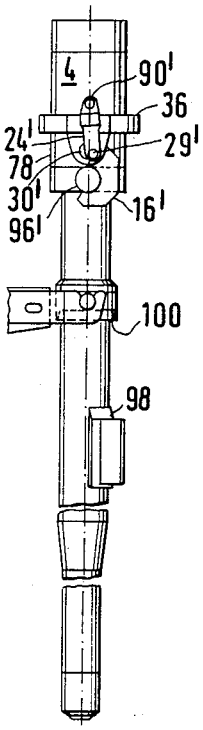

In FIG. 3d, the lance carriage, with coupling head 4, has maintained its position while lance 77 has been raised to define a gap of, for example, 20 mm by means of double carrying lever 82. The two coupling surfaces 74 and 80 thereby come into sealing contact and the conical surfaces 41 (see FIG. 2) and 79 on coupling head 4 and on the upper part 78 of the lance respectively likewise come to lie against on another. In this position of lance 77, its head 78 should now be firmly locked to coupling head 4. For this purpose, ring 36 is displaced upwards relative to coupling head 4 by means of the hook actuating mechanisms 14, 14', as is thereby also bearing pin 30' of hook 16'. Clearance 90 below upper wrist pin 68' of the connecting rod thereby disappears in a first phase so that in a second phase, as ring 36 continues to be raised, connecting rod 24' from now on presses against eccentric bolt 29', principally with the force of the compression spring 72' (not shown, but see in this connection spring 72 in FIG. 2) associated with the lever, hook 16' thereby pivoting clockwise about and surrounding the supporting pin 96'. As far as the lance coupling operation shown in FIGS. 3*a* to 3*g* is concerned, the task of connecting rod 24' has thus been fulfilled. As ring 36 is raised further, in a third phase, hook 16' can no longer execute a pivoting movement since it now rests against pin 96' with the result that during this further raising of ring 36 and hence of hook 16', the latter presses the upper part 78 of the lance with great force against coupling head 4. This contact pressure is given an exactly predetermined value, upon the reaching of which the load cells (see also in this connection, load cell 64 in FIG. 2) of hook actuating mechanisms 14, 14' stop drive motor 18 (FIG. 1) of the latter. This end position is illustrated in FIG. 3*e*.

On comparing FIGS. 3*d* and 3*e*, it can be seen that ring 36 in FIG. 3*e* occupies a higher position relative to coupling head 4 than in FIG. 3*d*. It is during this relative shift of ring 36 with respect to head 4 that the three phases described above occur.

In FIG. 3*e*, it can furthermore be seen that clearance 90 at underside of pin 68' (FIG. 3*d*), which disappeared in the first phase described above, has now reappeared as clearance 90' above this pin 68'. If therefore, connecting rods 24, 24' were designed as rigid, one-piece elements instead of part connecting rods displaceable one within the other and having an interposed compression spring (see also in this connection 24, 24*a*, 24*b*, 72 in FIG. 2), a rigid connecting rod of this kind might experience an excessive compression load and be bent.

Figure 3F:
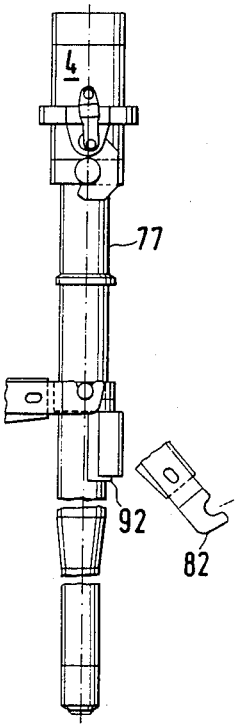
Figure 3G:
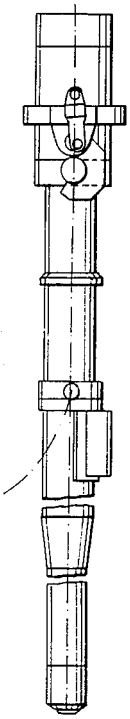

FIG. 3*f* shows the additional anchoring of lance 77 at stabilizing cradle 92 provided on lance carriage 10 (FIG. 1), which is not shown. For this purpose, carriage 10 is displaced upwards with coupling head 4 of lance 77 while double carrying arm 28 with axially displaceable sleeve 86 remains in the same position. In the end phase of this lance movement, outwardly conical upper part 98 of stabilizing cradle 92 pushes into inwardly conical lower part 100 (FIG. 3*e*) of the sleeve 86; Lance 77 is then rigidly connected to carriage 10, both by the coupling of lance head 78 at coupling head 4 and on the other hand by the interaction of sleeve 86 on the lance with cradle 92 on the carriage. Double carrying arm 82 of the lance transfer car can thereupon be released. This operation is illustrated in FIG. 3*g*.

The removal of a worn-out lance 77 is of course effected in analogous fashion and with the order of sequential movements shown in FIGS. 3*a* to 3*g* reversed. A relevant position in this context corresponds to the position in FIG. 3*e*, from which, when lance 77 is removed, hook 16' must release supporting pin 96'. To make it possible for hook 16' to be pivoted around in the counterclockwise direction at all, it must first of all, with the upper part 78 of lance 77 remaining in the same position, be initially displaced downward without a pivoting movement. This is accomplished by the lowering of ring 36 by means of hook actuating mechanisms 14, 14'. In a first phase of this procedure, hook 16 does not execute a pivoting movement since, for as long as a clearance 90' is present, connecting rod 24' cannot exert any force on eccentric bolt 29' on hook supporting pin 30'. This clearance 90' is dimensioned such that when, during the lowering of ring 36, it has completely disappeared (and appears as clearance 90, FIG. 3*d*), hook 16' has released supporting pin 96' to such an extent that a pivoting movement has been completed in FIG. 3*d*. The purpose of the presence of such a clearance 90 or 90' (or 66 in FIG. 2) has thus been explained.

While preferred embodiments have been shown and described, various modifications and substitutions may be made there to without departing from the spirit and scope of the invention. Accordingly, it is to be understood that the present invention has been described by way of illustrations and not limitation.

What is claimed is:

1. Automatic lance changeover device for coupling lances to a vertically displaceable lance carriage during metal refining, the substances required for the metal refining being delivered to a lance carriage coupling head on the lance carriage and being transferred into the lance, comprising:

at least one pair of lance receiving hooks attached to said lance carriage coupling head, one each of said hooks being positioned on opposed sides of said lance carriage coupling head;

vertical displacement means for the synchronous vertical displacement of said hooks relative to said lance carriage and to said coupling head;

pivoting means for pivoting said hooks about a horizontal axis of rotation of said hooks while said horizontal axis is vertically displaced by said vertical displacement means; and load detection means for detecting the load acting on said hooks.

2. The lance changeover device according to claim 1 wherein said vertical displacement means is comprised of:

at least one lifting spindle means positioned above said hooks;

a ring, displaceable along said coupling head, said hooks being suspended on said ring; and a drive motor which drives said vertical displacement means.

3. The lance changeover device of claim I wherein said load detection means is comprised of:

at least one load cell which measures the load acting on said hooks.

4. The lance changeover device of claim 2 wherein said load detection means is comprised of:

at least one load cell which measures the load acting on said hooks.

5. The lance changeover device of claim 3 wherein said load cell includes:

signal means which signals said drive motor to stop when a predetermined maximum load on said hooks is reached.

6. The lance changeover device of claim 4 wherein said load cell includes:

signal means which signals said drive motor to stop when a predetermined maximum load on said hooks is reached.

7. The lance changeover device of claim 1 wherein said pivoting means includes:

at least one connecting rod for each of said hooks, said connecting rod being articulated at an upper end to said coupling head which forms a mechanical unit with said carriage, and being eccentrically connected at a lower end to at least one rotatable bearing pin.

8. The lance changeover device of claim 7 wherein said connecting rods include:

limiting means for limiting the maximum length of the connecting rods, said limiting means being comprised of two parts which are inserted one in the other and which can be longitudinally displaced relative to one another.

9. The lance changeover device of claim 8 wherein said limiting means include:

at least one spring to subject said parts of said limiting means to a compression force.

10. The lance changeover device of claim 9 which includes:

at least one connecting rod bore by which said connecting rods are articulated on said carriage or on said bearing pin of said hooks.

11. The changeover device of claim 10 including a wrist pin associated with said bore and wherein:

said bore has a larger diameter than said associated wrist pin

12. The lance changeover device of claim 7 which includes;

at least one connecting rod bore by which said connecting rods are articulated on said carriage or on said bearing pin of said hooks 13. The changeover device of claim 12 including a wrist pin associated with said bore and wherein:

said bore has a larger diameter than said associated wrist pin.

14. Lance changeover device of claim 1 which includes: includes:

a lance; and a sleeve on said lance, said sleeve being longitudinally displaceable along said lance, said lance being anchored by said sleeve to said hooks.

* * * * *